US005381918A

United States Patent [19]

Dahl

[11] Patent Number: 5,381,918

[45] Date of Patent: Jan. 17, 1995

[54] DEVICE FOR SECURING THE LID OF A CAN, IN PARTICULAR, A CAN OF PAINT

[75] Inventor: Jürgen Dahl, Wuppertal, Germany

[73] Assignee: Herberts Gesellschaft mit beschrankter Haftung, Germany

[21] Appl. No.: 166,162

[22] Filed: Dec. 10, 1993

Related U.S. Application Data

[63] Continuation of Ser. No. 931,116, Aug. 17, 1992, abandoned, which is a continuation of Ser. No. 595,385, Oct. 10, 1990, abandoned.

[30] Foreign Application Priority Data

Oct. 18, 1989 [DE] Germany ..... 8912367[U]

[51] Int. Cl.[6] ..... B65D 51/18

[52] U.S. Cl. ..... 220/256; 220/306; 220/315; 220/694; 206/508

[58] Field of Search ..... 220/256, 306, 315, 319, 220/694, 729, 730, 733; 215/273, 274, 277; 206/508

[56] References Cited

U.S. PATENT DOCUMENTS

| | | | |
|---|---|---|---|
| 2,104,540 | 1/1938 | Hoffman | 220/256 X |
| 2,913,140 | 11/1959 | Vuillemenot | 220/306 |
| 3,018,931 | 1/1962 | Westgate | 222/480 |
| 3,173,574 | 3/1965 | Goldsmith | 220/306 X |
| 3,269,588 | 8/1966 | Ruekberg | 220/306 |
| 3,850,341 | 11/1974 | Bart | 220/212 |
| 4,042,143 | 8/1977 | Biggins | 220/256 |
| 4,165,018 | 8/1979 | Giggard | 220/284 |
| 4,230,230 | 10/1980 | Mumford | 215/321 |
| 4,252,265 | 2/1981 | Brundige et al. | 220/306 X |
| 4,305,535 | 12/1981 | Brundige et al. | 220/306 X |
| 4,315,576 | 2/1982 | Murphy et al. | 220/282 |
| 4,346,815 | 8/1982 | Raymor et al. | 220/306 |
| 4,494,674 | 1/1985 | Roof | 220/306 |
| 4,540,099 | 9/1985 | Swartzbaugh et al. | 215/252 |
| 4,728,003 | 3/1988 | Davey | 220/319 |
| 4,932,554 | 6/1990 | Smith et al. | 220/319 |
| 5,040,694 | 8/1991 | Gambello | 220/255 |

FOREIGN PATENT DOCUMENTS

| | | | |
|---|---|---|---|
| 0234026 | 10/1963 | Austria | 220/256 |
| 294781 | 12/1988 | European Pat. Off. | 220/256 |
| 0383745 | 8/1990 | European Pat. Off. | 220/729 |
| 0104813 | 3/1917 | United Kingdom | 220/256 |

*Primary Examiner*—Allan N. Shoap
*Assistant Examiner*—Stephen Cronin
*Attorney, Agent, or Firm*—Fitch, Even, Tabin & Flannery

[57] ABSTRACT

Device for securing the lid of a can, in particular a can of paint, against opening when this is not desired, with a surface at the upper end and a peripheral side wall forming a hollow body and consisting of two sections with different diameters, and with a projection arranged at a distance from the upper end of the device and on the inside of the first section of the side wall, which projection is designed so as to be largely peripheral.

6 Claims, 3 Drawing Sheets

FIG. 2
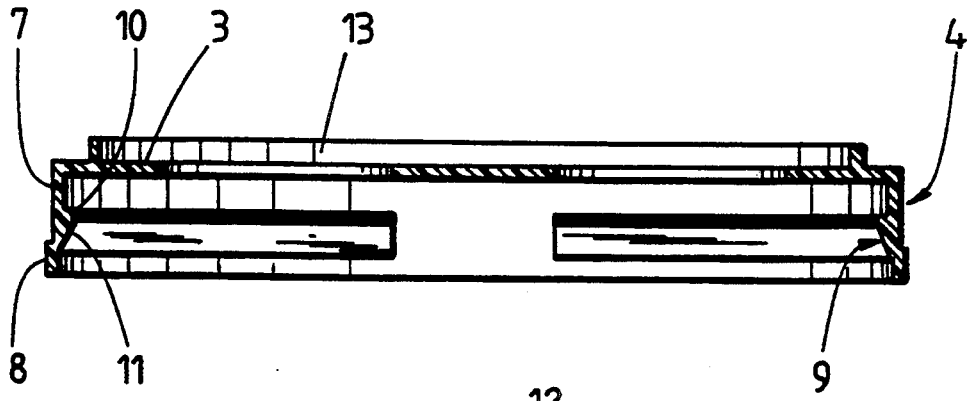
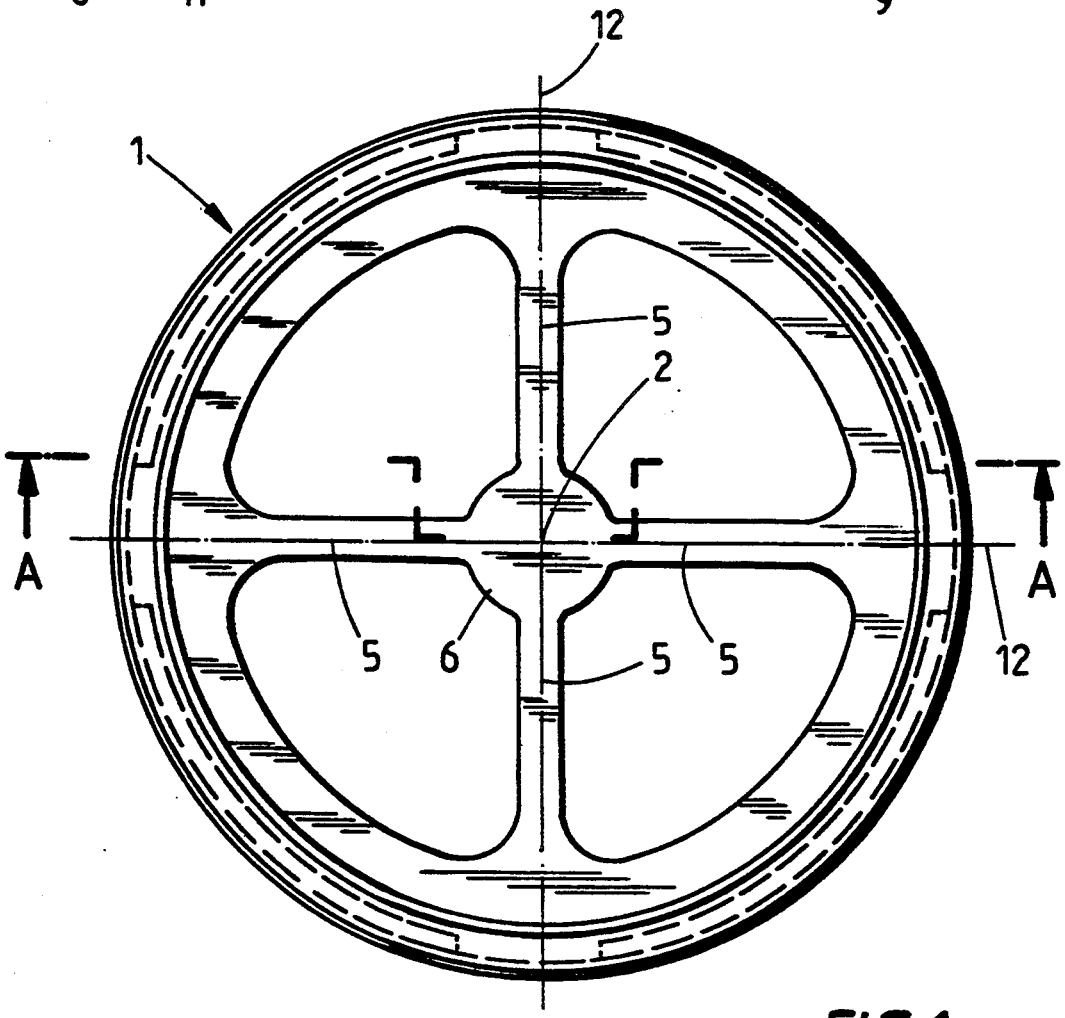
FIG. 1

DEVICE FOR SECURING THE LID OF A CAN, IN PARTICULAR, A CAN OF PAINT

This application is a continuation of application Ser. No. 07/931,116, filed Aug. 17, 1992, now abandoned which is a continuation of application Ser. No. 07/595,385, filed Oct. 10, 1990, now abandoned.

The invention relates to a device for sectoring the lid of a can, in particular a can of paint, against opening when this is not desired, with a surface at the upper end and a peripheral side wall forming a hollow body and consisting of two sections with different diameters, and with a projection arranged at a distance from the upper end of the device and on the inside of the first section of the side wall.

Cans, in particular cans of enamel paint (for instance, cans with press-in lids according to DIN 2028) are frequently provided with a lid such as a press-in lid. Cans with an aperture of more than 70 mm must, for safety-technical reasons, be secured against opening during transportation when this is not desired.

Hitherto such safety devices have consisted of a kind of yoke which must be secured to the can with the aid of two holders and protects the lid of the can against opening, when this is not desired, by holding it down. However, with this method it is also necessary to provide holders for securing the yoke, as a result of which the costs of producing the cans increase. If such yokes are used it is also impossible to stack the cans.

Another possibility of securing the lid consists in the use of clamps, which must however be applied manually and can be released only with the aid of a technical implement. Handling of such cans has proved to be impracticable.

It is also known how to secure the lid of a can by means of devices which, inasmuch as they are cap-type hold-down devices, are mounted on the can closed by means of the lid. Such cap-type hold-down devices have at their upper end a surface and are provided with a peripheral side wall forming a hollow body and consisting of two sections with different diameters, and with a projection arranged at a distance from the upper end and on the inside of the first section of the side wall. Such a device is described in the German utility model G 87 08 272.1. With such a device it may, after the lid has been fitted on a can, be difficult and time-consuming to move the device for securing the lid from the can.

Furthermore, an increased use of force is required for applying the lid, so that there is a risk of dispensing, owing to the difficulties when handling the safety device, with further use after initial utilisation of the cans of paint.

Furthermore there is a risk of these being damaged owing to excessive use of force when removing the safety device, so that further use or further application of the safety device is not possible.

The invention has the object of providing a device for securing the lid of a can, in particular a can of paint, which prevents, in particular during transportation and in case of improper use, opening of the can when this is not desired, while at the same time being easy to manipulate so that it is suitable also for use between several times in which use is made of the can of paint, without, however, quickly losing its effectiveness owing to repeated use.

With the device of the type mentioned initially, which is a cap-type hold-down device, this object is achieved by the projection arranged at the inside of the first section of the side wall being so designed as to extend along the periphery only to a large extent, i.e. in such a manner that its start in the peripheral direction is at a distance from its end. Hence the projection is not designed as a closed peripheral ring, but has at least one gap. It can also consist of several sections, for instance two, four or eight sections.

Inasmuch as according to the invention the device for securing the lid of a can, in particular a can of paint, comprises a projection largely designed in a peripheral manner, the start of which in the peripheral direction is arranged at a distance from its end, the can can be removed without excessive use of force being required to this end, since an auxiliary tool such as a screwdriver, which in any case is necessary for opening the can, can be introduced into the gap or gaps between the start and the end or between the sections of the projection, it being easy to remove the safety device from the can by these means without any risk of destroying the safety device.

If the projection consists of two sections, each of which starts at a distance from the centre axis of the device and ends at a distance from said centre axis, this is a particularly advantageous embodiment of the safety device according to the invention.

If the projection consists of four or more, e.g. eight, sections, each of which starts at a distance from one of the two centre lines and ends at a distance from the second centre line arranged at a right angle thereto, the result is a safety device enabling insertion of an auxiliary device such as a screwdriver into a plurality of gaps provided for accommodating such an auxiliary device in order to remove the safety device from the can without a special use of force.

If the side of the projection facing the upper end is so designed as to be both plane and parallel to the surface at the upper end, this ensures particularly good seating of the safety lid.

The surface at the upper end of the device can be so designed as to form a ring and provided with one or more tie-bars. With this design less material is required than with an entirely closed surface.

With a view to facilitating storage of several cans one above the other, the device can be provided with a so-called stacking bead. This is a vertically arranged ring on the top side of the surface at the upper end, which engages the usual indentation in the bottom of the can of the can to be stacked immediately above, thus ensuring non-slip stacking. The outer and inner diameters of the ring may be smaller than those of the device in its entirety. However, its outer diameter can also be identical with the outer diameter of the device, i.e. the ring can be so designed as to constitute an extension of the side wall. The ring can be made continuous but it can also be provided with notches on the inside or it may be designed with gaps. Notches or gaps ensure that in case of impact loading only certain points of the ring suffer mechanical damage so that the ring continues to be usable. Hence the stacking bead also serves as a protection against impacts or falls. Furthermore, the said stacking bead serves to stabilize the safety device according to the invention.

According to a preferred embodiment, the device according to the invention has, on the surface at the upper end facing the lid of the can which is to be secured, several lug-shaped projections (lugs). These lugs are so arranged as to rest, when they are mounted on the can provided with its lid, on the edge of the lid and press the latter against the inner edge of the can. For this reason, the lugs are preferably provided along a circular track located on the surface at the upper end of the device at a distance from the peripheral side wall. The distance from the peripheral side wall is such that the lugs press against the edge of the lid to be secured. However, it is also possible to provide one or several lugs inside the peripheral circular track, for instance at the centre of the lid, in order to achieve a further securing effect. The lugs are so designed as to be individual features and not a peripheral surface in order to make it easier to remove or open the device. The circular track may be provided with several, for instance four, six or eight, lugs.

Owing to the design of the safety device it is possible to remove it from the can to be secured without an increased use of force, so that damage to the safety device is effectively obviated and, thanks to its simple and safe manipulation, repeated use of the safety device is enabled.

The device according to the invention may be made from different materials, in particular plastics. Examples of such plastics are polyethylene and polypropylene. If use is made of polyethylene, the necessary strength and good flexibility when fitting the device to the can or removing it therefrom are achieved. Polypropylene ensures that the device is capable of functioning well.

The drawing shows, in diagrammatic form, an embodiment of the device according to the invention, i.e.

FIG. 1 shows a top view of the device according to the invention,

FIG. 2 shows a cross-section according to line A—A in FIG. 1,

Figure 3:
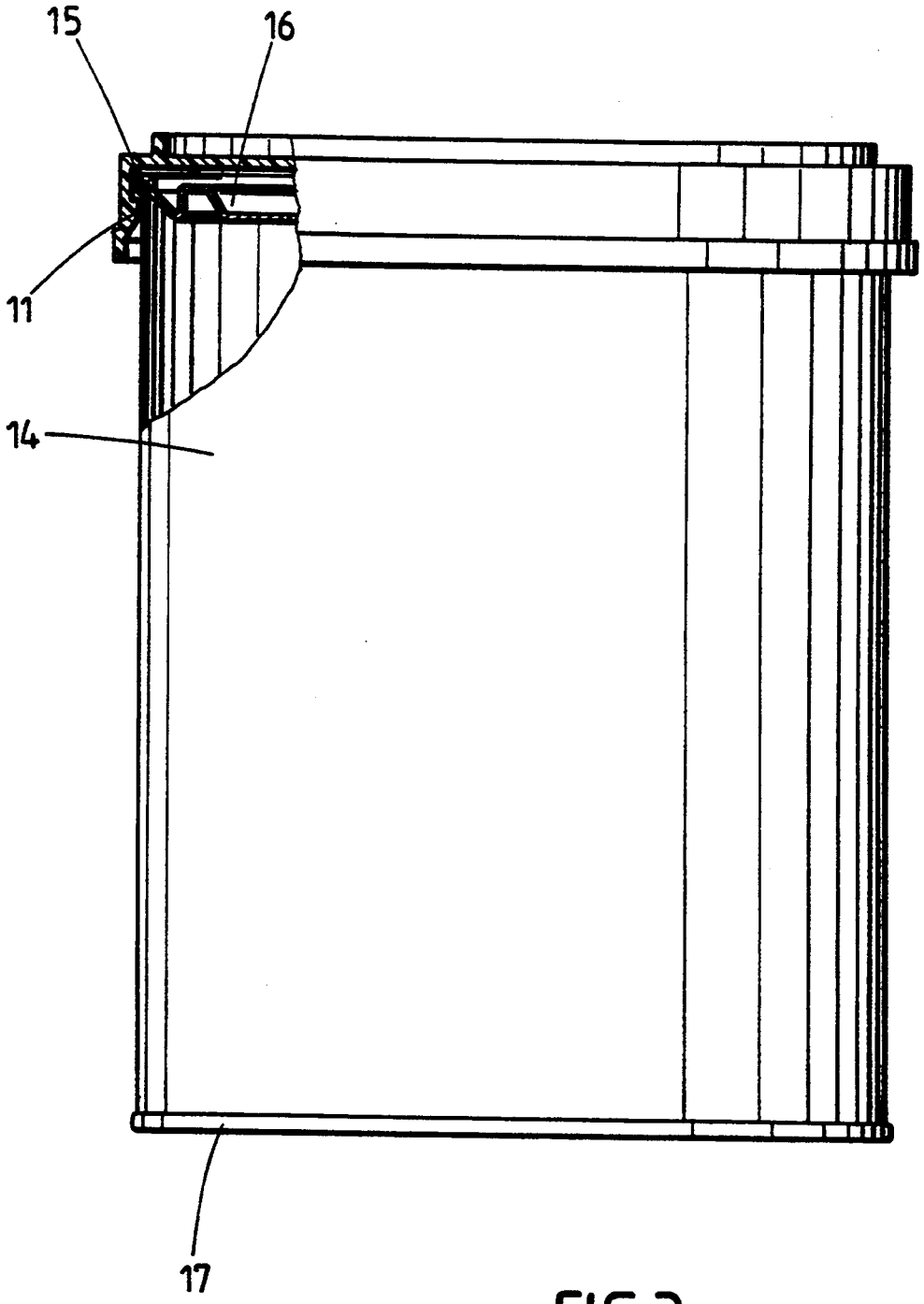
FIG. 3 shows a side view of the can provided with a press-in lid, with a partially cut-away view of the device according to the invention.

As shown in FIG. 1, device 1 is designed as a circular cap-type hold-down device and has at its upper end a ring 3 partly closing said hold-down device, a side wall 4 forming a hollow body being arranged peripherally along its outer edge (see FIG. 2). Ring 3 is arranged coaxially with centre point 2 of device 1 and ends with its inner edge facing the centre point at a distance from the outer edge, said distance amounting in the present embodiment to about 12.5 mm. However, a smaller or larger distance from the inner edge is also feasible, as is a totally closed surface at the upper end.

Ring 3 has, at its inner diameter, four tie-bars 5 arranged in crosswise manner, connecting in each case opposite sections of the inside of the ring and made in one piece with the latter, said tie-bars being arranged at a distance of 90° in respect of one another, their ends facing ring 3 being connected, in radiused manner, with ring 3 or its inner diameter, respectively. The number of tie-bars 5 can also be higher or lower than four, depending on the size of the can. The inner ends of tie-bars 5 meet at a circular centre 6, which is also coaxial with centre point 2 of of device 1.

Peripheral side wall 4 has two sections 7,8 of different diameters and different heights, whereby the first section 7 adjoining ring 3 of the upper end and constituting more than two thirds of the height of the wall has a diameter which, by comparison with that of the second section 8, is small.

The wall section adjoining ring 3 has, roughly in the middle of its wall height, a peripheral projection 9 facing inward and provided in each case with discontinuities coaxial with the centre lines, the inner diameter of said projection being smaller than the diameter of the first section, whereas its side 10 facing ring 3 is designed so as to be plane and is arranged parallel to ring 3.

The side of projection 9 facing away from ring 3 is designed as bevel 11, which, at the edge forming the inner diameter of projection 9, drops off towards the end of the end wall section 7 facing away from ring 3 in such a manner that at this point the inner diameter of first section 7 and the inner diameter of bevel 11 of projection 9 starting at this point are identical.

Second section 8 of side wall 4 has, by comparison with first section 7, a larger diameter and starts at the side of projection facing away from ring 3, respectively, while ending at a distance from the latter.

Projection 9 is in every case provided with discontinuities coaxially with the centre lines of device 1 or tie-bars 5, respectively, i.e. it starts and ends in every case at a distance from centre lines 12 as shown in FIGS. 2 and 1.

The side of ring 3 of hold-down device 1 facing away from side wall 4 is provided with a rib-type second ring 13 as shown in FIG. 2, said ring being arranged concentrically peripheral and at a distance from the outer edge of horizontal ring 3, as shown in FIG. 1. Furthermore, ring 13 is arranged vertically, i.e. at an angle of 90°, in respect of ring 3.

Horizontal ring 3 as well as tie-bars 5, centre 6, side wall 4 and projection 9 are made in one piece.

Hold-down device 1 can be stacked together with others both before and after use, whereby second section 8 of side wall 4 at least partly encompasses in every case first section 7 of side wall 4 of hold-down device 1 immediately below, and annular surface 3 of the upper end and the outer edge of the surface on the side of ring 13 facing away from side wall 4 of lower hold-down device 1 engages the underside of projection 9 or bevel 11 of projection 9 of hold-down device 1 immediately above, so that a plurality of devices can be stacked in non-slip manner one above the other.

During application of the cap-type hold-down device 1, the latter is mounted on the upper end of a can and a conventional lid, as shown in FIG. 3. To this end, projection 9 is so pressed over bead 15 at the upper end of can 14 as initially to cause bevel 11 to slide along bead 15 so that face 10 of projection 9 facing the upper end of hold-down device 1 and designed in plane manner engages the underside of bead 15 and hold-down device 1 is firmly seated on can 14. In this state there is a small distance or only slight contact between the underside of ring 3 and tie-bars 5 of hold-down device 1 and lid 16 which is to be secured, thus ensuring that projection 9 encompasses bead 15 also if the height of said bead is subject to any tolerances. Owing to the small distance or slight contact between the underside of ring 3 and tie-bars 5 and the upper face of lid 16 and owing to the firm seat of device 1, only a slight theoretical displacement of lid 16 is possible, i.e. a displacement the effect of which is insignificant, as a result of which said lid remains closed by means of hold-down device 1 even with inappropriate use of can 14, i.e. if for instance can 14 falls from the platform of a truck.

Owing to the recesses or discontinuities provided in projection 9 along its peripheral extent, it is possible to introduce, with a view to removing hold-down device 1, a tool or auxiliary device between bead 15 of can 14 and side wall 4 of hold-down device 1, so as to be able to detach hold-down device 1 from can 14 without the use of force or any other problems.

If several cans are to be stored, they can also be stacked one above the other with the aid of hold-down device 1, in which case ring 13 vertically arranged on hold-down device 1 engages the special or conventional indentations 17 in the bottom of the can (as shown in FIG. 3) of the can to be stacked immediately above, thus ensuring non-slip storage or stacking, respectively, of cans.

Figure 5:
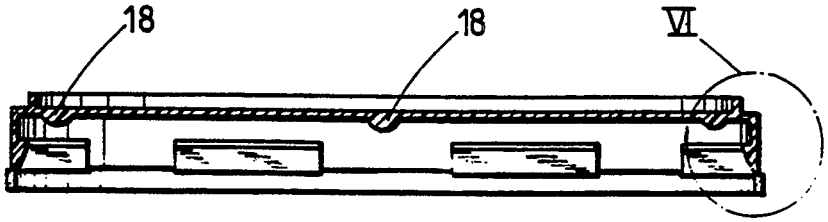
FIG. 5 shows a cross-section according to line A—A in FIG. 4.
Figure 4:
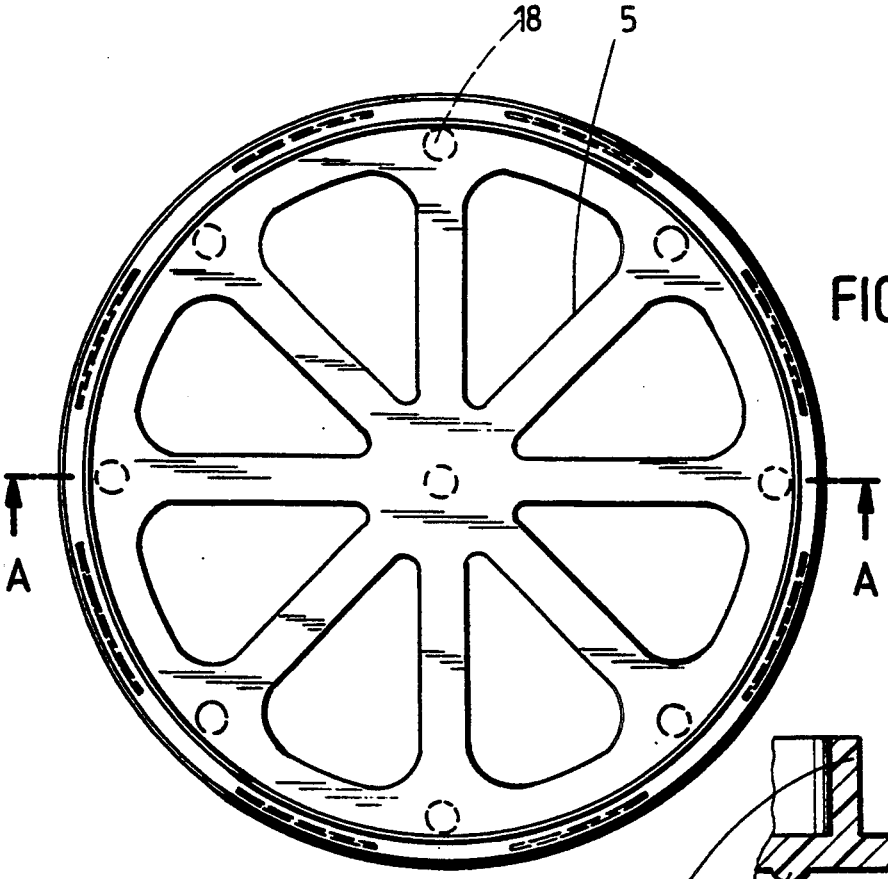
FIG. 4 shows a further top view of the device according to the invention.

FIG. 4 shows an embodiment of the device according to the invention, with eight tie-bars 5. Furthermore, lugs 18 are shown with this embodiment, which, as can also be seen in FIGS. 5 and 6 constituting a cross-section or partial cross-section of FIG. 4, are arranged in such a way as to extend from the surface at the upper end inward. They may press against the edge of the lid mounted on the can and press said edge of the lid against the inner edge of the can. Also shown is a lug 18 which can press or be pressed against the centre of the lid of the can. In all other respects reference is made to the comments in respect of FIG. 1 with a view to explaining the embodiment shown in FIGS. 4, 5 and 6. The reference numbers used in regard to side wall 4, projection 9 and ring 13 (stacking bead) in FIG. 6 are the same as the reference numbers in FIG. 2.

Figure 6:
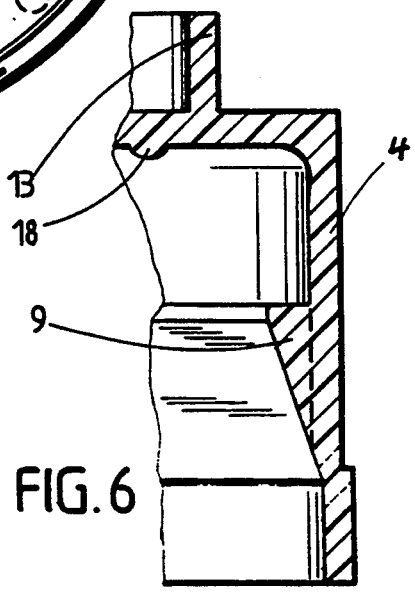
FIG. 6 shows a partial cut-away view of the cross-section according to line A—A in FIG. 4.

FIG. 6 shows ring 13 at a distance from the side wall, i.e. its outer and inner diameters are smaller than the overall diameter of the device. However, ring 13 can also be displaced towards the outer edge so as to form an extension of side wall 4.

I claim:

1. A securing device of unitary one piece construction formed of semi-rigid plastic for securing and protecting the lid of a can against opening or damage thereto comprising:

a) a flat planar ring having an inner and outer diameter and having an upper and lower surface and having a plurality of lug-shaped projections on said lower surface;

(b) a plurality of flat tie-webs extending inwardly from the inner diameter of said planar ring to a central connection point coplanar with the upper surface of said ring;

(c) a peripheral wall extending downwardly from the lower surface of said ring at the outer diameter thereof, said peripheral wall including a lower section extending outwardly from the peripheral surface of the wall section at the lower end thereof, said peripheral wall having an inner and outer surface defining a cavity adapted for encompassing the top bead of a can to be protected and secured;

(d) at least one securing projection formed on and affixed to the inner, lower surface of said peripheral wall, said projection extending upwardly and angularly inwardly from a point proximate to the interior top portion of said lower peripheral wall section and terminating in a flat upper surface parallel to the lower surface of said planar ring to form at least one discontinuous arcuate sector adapted to secure a peripheral bead on the top of a can to be protected and secured by the device; and (e) a ring-like cylindrical section affixed to and extending upwardly for a predetermined distance from the upper surface of said planar ring, said cylindrical section being coaxial with the center of said planar ring.

2. A securing device according to claim 1 which includes at least two tie-webs.

3. A securing device according to claim 1 wherein the ring-like cylindrical section is spaced inwardly from the outer diameter of said planar ring.

4. A securing device according to claim 1 which is integrally molded in one piece.

5. A securing device according to claim 4 wherein the device is from a polyethylene or polypropylene type plastic.

6. A securing device according to claim 1 which includes at least four tie-webs.

* * * * *